US007958592B2

(12) United States Patent
Nobile et al.

(10) Patent No.: US 7,958,592 B2
(45) Date of Patent: Jun. 14, 2011

(54) CURVED PROFILE SPONGE MOP SYSTEM

(75) Inventors: David P. Nobile, Alta Loma, CA (US); Jackson S. Burnett, III, Spartanburg, SC (US)

(73) Assignee: Contec, Inc., Spartanburg, SC (US)

( * ) Notice: Subject to any disclaimer, the term of this patent is extended or adjusted under 35 U.S.C. 154(b) by 1038 days.

(21) Appl. No.: 11/788,276

(22) Filed: Apr. 19, 2007

(65) Prior Publication Data

US 2008/0256731 A1 Oct. 23, 2008

(51) Int. Cl.
*A47L 13/20* (2006.01)
*A47L 13/14* (2006.01)

(52) U.S. Cl. ..... 15/228; 15/231; 15/260

(58) Field of Classification Search ..... 15/228, 15/231, 260, 244.1–244.2
See application file for complete search history.

(56) References Cited

U.S. PATENT DOCUMENTS

| | | | | |
|---|---|---|---|---|
| 82,705 | A | 10/1868 | Gibson | |
| 1,778,121 | A | 10/1930 | Paull | |
| 2,023,132 | A | 12/1935 | Gringer | |
| 2,640,214 | A | 6/1953 | Zimmerman | |
| D211,197 | S | 5/1968 | Malmo | |
| 3,388,415 | A * | 6/1968 | Warner et al. | 15/233 |
| 3,465,377 | A | 9/1969 | Thomas | |
| 3,795,933 | A | 3/1974 | Senfert | 15/114 |
| 3,945,736 | A | 3/1976 | Rittenbaum et al. | 401/289 |
| 4,216,562 | A | 8/1980 | Strahs | 15/119 |
| 4,852,210 | A | 8/1989 | Krajicek | 15/228 |
| 4,903,366 | A | 2/1990 | Traglia | 15/119 |
| D358,972 | S | 6/1995 | Libman | |
| 5,507,065 | A | 4/1996 | McBride et al. | 15/228 |
| 5,678,278 | A | 10/1997 | McBride et al. | 15/228 |
| D403,820 | S | 1/1999 | Chang | 32/50 |
| 6,058,552 | A | 5/2000 | Hanan | 15/228 |
| 6,148,465 | A | 11/2000 | Hsich et al. | 13/257 |
| 6,170,114 | B1 * | 1/2001 | Woodnorth et al. | 15/210.1 |
| D452,053 | S | 12/2001 | Denney | |
| D490,952 | S | 6/2004 | Ajluni | |
| D496,512 | S | 9/2004 | Treacy | |
| D501,971 | S | 2/2005 | Treacy | |
| D520,698 | S | 5/2006 | Libman et al. | |
| 2006/0248673 | A1 | 11/2006 | Piscane | 15/228 |
| 2006/0248674 | A1 | 11/2006 | Piscane | 15/244.3 |

FOREIGN PATENT DOCUMENTS

| | | |
|---|---|---|
| WO | WO 00/19882 | 4/2000 |
| WO | WO 2006/098898 | 9/2006 |

* cited by examiner

*Primary Examiner* — Laura C Guidotti

(57) ABSTRACT

A mop system incorporating a replaceable foam-based mop head. The mop head is adapted to wrap at least partially around a curved support mandrel and to be held in place by releasable engagement between the mandrel and connection elements disposed in localized relation along edge portions of the mop head.

14 Claims, 8 Drawing Sheets

CURVED PROFILE SPONGE MOP SYSTEM

TECHNICAL FIELD

This invention relates generally to mopping systems and more particularly to a mop system providing a curved profile cleaning structure adapted to facilitate cleaning of horizontal, vertical and intermediate surfaces. A wringing system for such a profile structure is also provided.

BACKGROUND OF THE INVENTION

Mopping systems incorporating replaceable sponge-based refills are generally known. By way of example, replaceable sponge-based mop heads are described in U.S. Pat. No. 4,216,562 to Strahs, U.S. Pat. No. 6,058,552 to Hanan and U.S. Pat. No. 6,148,465 to Hsieh et al., the teaching of all of which are incorporated herein by reference. As will be appreciated, prior mop constructions have typically relied on relatively complex clamping systems, solid surface attachment plates, and/or threaded attachment elements such as screws and the like in order to provide a desired operative connection between a replaceable refill and the handle structure. Each of these attachment systems has certain inherent limitations. By way of example, systems which utilize clamping engagement between a mop head and handle structure may require a relatively complex clamp structure which may tend to corrode, pinch or otherwise degrade over time in the presence of cleaning solutions. Likewise, mop systems which utilize screws and/or other threaded fasteners may be prone to premature failure at the point of mechanical connection. The need to utilize tools for installation is also a problem for the users of these types of mops. Systems which utilize foam refills backed by solid surface connection plates may be difficult to conform to desired geometries during use. Mopping systems incorporating such traditional attachment techniques may also be prone to damage when subjected to autoclave sterilization procedures as may be required for many environments of use including pharmaceutical production, electronic clean rooms, and the like.

In order to improve the ability of the mop components to undergo autoclave processing U.S. Pat. Nos. 5,507,065 and 5,678,278 to McBride et al. (incorporated herein by reference) disclose systems incorporating autoclaveable, replaceable foam-based mop heads. While such systems provide many benefits, they nonetheless retain a relatively flat cleaning surface. As will be appreciated, In some environments of use, a curved cleaning surface may be desirable.

SUMMARY OF THE INVENTION

The present invention provides advantages and/or alternatives over the prior art by providing a mop system incorporating a curved support mandrel and a complimentary replaceable foam-based mop head. The mop head is adapted to wrap at least partially around the support mandrel and to be held in place by releasable engagement between the mandrel and connection elements disposed in localized relation along edge portions of the replacement head.

According to another aspect of the invention, a bucket supported wringing system is provided adapted to provide a shape conforming pressure application to the mop head to facilitate fluid extraction.

Other aspects and features of the invention will become apparent to those of skill in the art through reference to the following detailed description of exemplary embodiments and accompanying figures and/or through practice of the invention.

While the invention has been illustrated and will hereinafter be described in connection with certain exemplary and potentially preferred embodiments, practices and procedures, it is to be understood that the invention is in no way limited to any such illustrated and described embodiments, practices or procedures. Rather, it is to be understood that it is the intention of the applicants to cover all alternatives and modifications and all equivalents thereto as may fall broadly within the trust spirit and scope of the inventive concepts herein.

DESCRIPTION OF PREFERRED EMBODIMENTS

Figure 1:
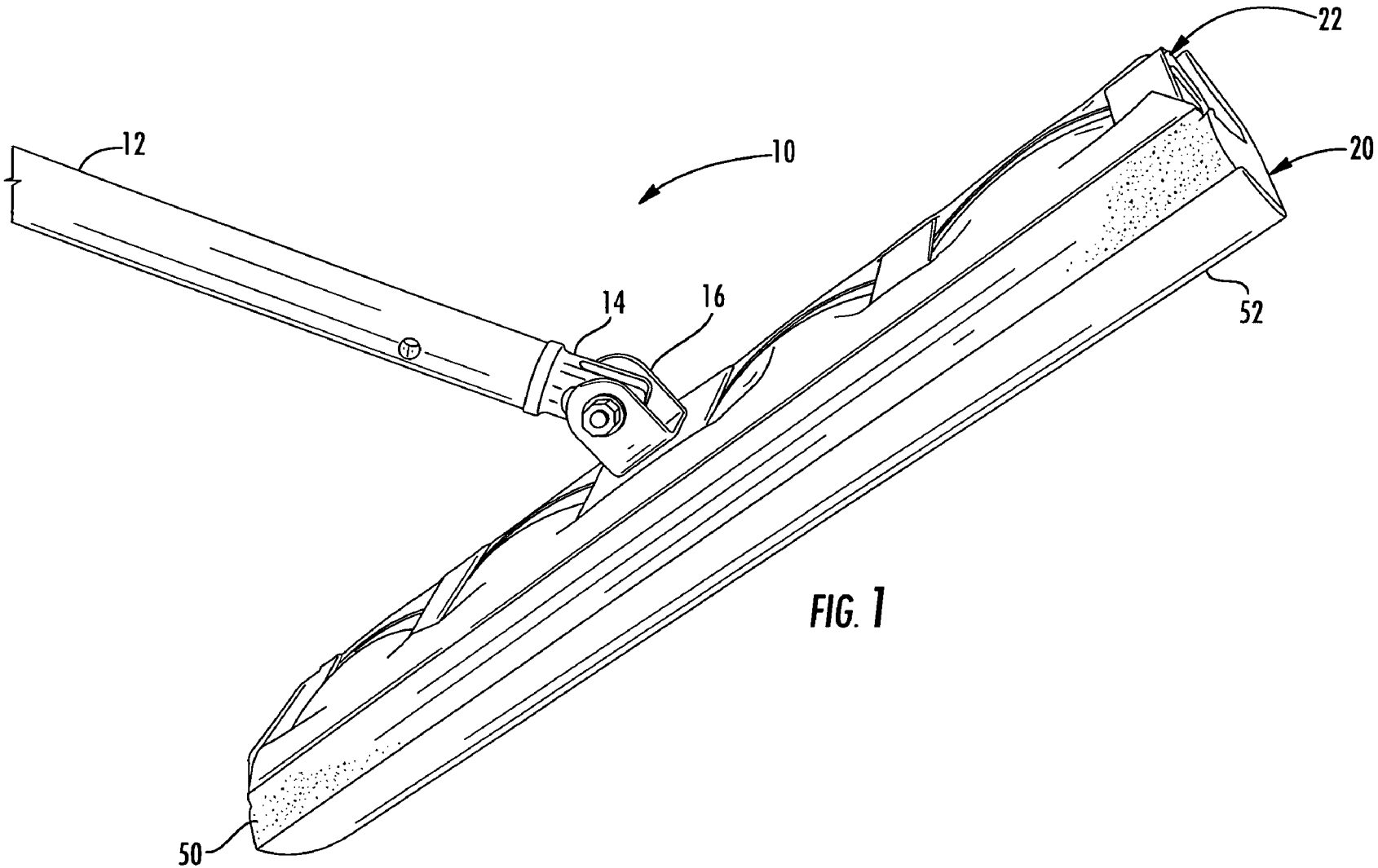
FIG. 1 is a perspective view of a mop incorporating a handle structure in attached relation to a support mandrel with a foam-based mop head secured in partial wrapped relation around the support mandrel.

Reference will now be made to the drawings wherein to the extent possible like reference numerals are utilized to designate like elements throughout the various views. Referring to FIG. 1, an exemplary mop 10 is illustrated. As shown, the mop 10 includes an elongate handle 12 attached to a pivoting handle connection 14. In the illustrated and potentially preferred configuration, the handle connection 14 is held in pivoting relation within a bracket structure 16 such that the handle 12 may be pivoted in an arc within a predefined plane.

As illustrated, the mop 10 includes a replaceable mop head 20 disposed in curved wrapped relation at least partially around a supporting mandrel 22 to which the bracket structure 16 is attached. The mop head 20 is held in place by engagement across an upper surface of the mandrel in a manner as will be described more fully hereinafter. Thus, in the illustrated embodiment a mop is provided having a generally curved cleaning surface which is stabilized and held in place by a supporting mandrel. A user engaged handle may be pivoted in an arc within a plane corresponding substantially to the major length dimension of the mandrel so as to provide an adjustable cleaning surface such as may be useful in cleaning walls or other non horizontal structures.

Figure 2:
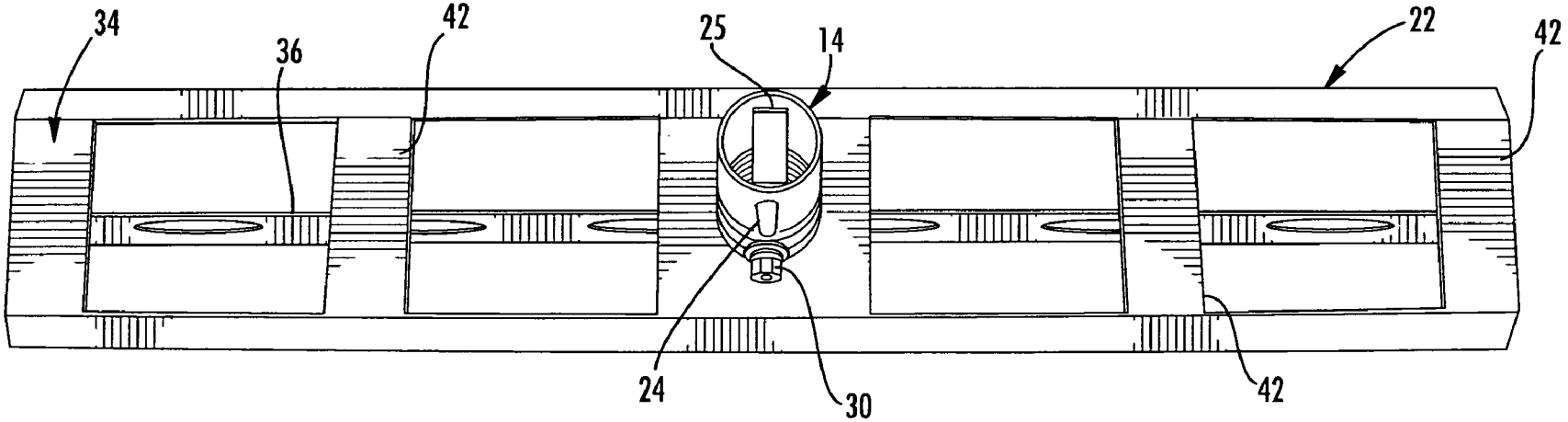
FIG. 2 is an elevation view of the mandrel and handle connection with the mop head removed.
Figure 3:
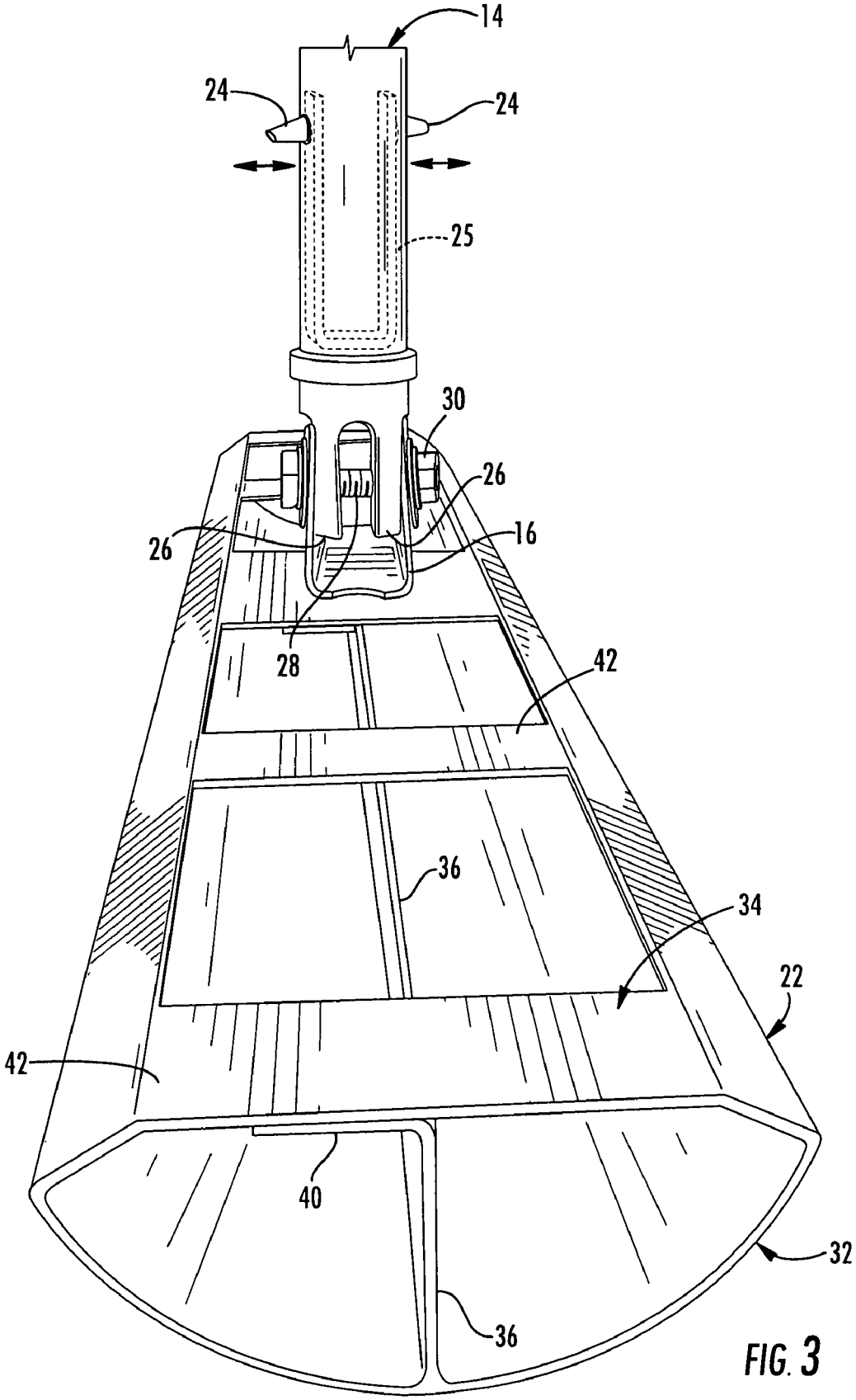
FIG. 3 is a perspective end view of the mandrel and handle connection with the replaceable mop head removed.
Figure 4:
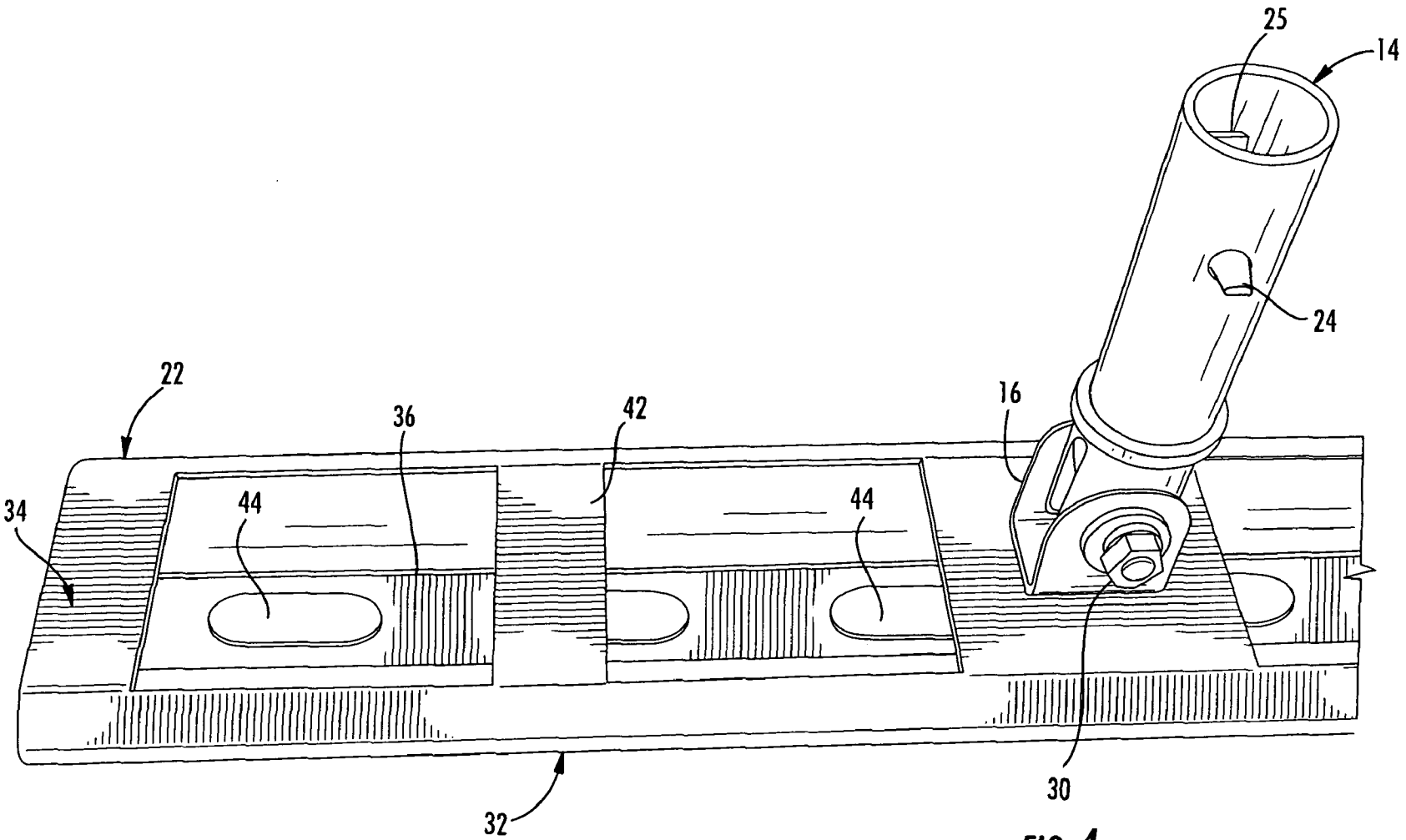
FIG. 4 is a perspective side view of the mandrel with handle connection with the replaceable mop head removed.

Referring simultaneously to FIGS. 2, 3, and 4, various features of the mandrel 22 and handle connection 14 will now be described. As shown, the handle connection 14 is preferably substantially tubular in construction incorporating a pair of outwardly projecting spring bias pin elements 24 adapted to engage openings in the handle 12 when the handle is placed over the handle connection 14. In the illustrated and potentially preferred construction, the spring biased pin elements 24 are operatively connected to a biasing element in the form of a compressible U-shaped leaf spring 25 disposed at the interior of the connection 14. However, virtually any other suitable biasing structure may likewise be used if desired.

As noted previously, the handle connection 14 is preferably held in pivoting relation within bracket structure 16. In the illustrated construction, the bracket structure 16 is a substantially U-shaped bracket adapted to accept a pair of downwardly extending spaced legs 26 extending away from the base of the handle connection 14. A connecting bolt 28 extends across the bracket structure 16 and through the legs 26. A tensioning nut 30 secures the connecting bolt 28 in place and may be tightened or loosened so as to adjust the force required to pivot the handle connection 14 in the manner as may be desired.

As shown, the mandrel 22 preferably has a substantially lower curved profile surface 32 projecting away from the handle connection 14. In the illustrated and potentially preferred construction, the mandrel 22 also includes a substantially planar upper surface 34 of open-ribbed construction formed by an arrangement of substantially coplanar spaced ribs 42. A supporting spine 36 preferably extends between the lower curved profile surface 32 and the upper surface 34 substantially along the length of the mandrel. The spine 36 may be further supported by structural arm members 40 extending between the spine 36 and the underside of the spaced ribs 42 defining the upper surface 34. As illustrated, the spine 36 may include an arrangement of openings 44 along its length so as to reduce weight and material requirements. However, such openings may likewise be eliminated if desired.

As noted, the upper surface 34 of the mandrel 22 is preferably defined by an arrangement of substantially co-planar ribs which are spaced apart from one another and which extend transverse to the length dimension of the mandrel 22. In such a construction, a predefined arrangement of openings is established between the ribs 42 across the upper surface. As will be described more fully hereinafter, this arrangement of openings may be used to facilitate attachment of a mop head 20 to the mandrel. It is contemplated that the mandrel 22 is preferably formed of a material which provides both structural integrity and substantial corrosion resistance. In this regard, metals such as aluminum, stainless steel, or the like may be particularly preferred. However, it is likewise contemplated that other structural materials including plastics and the like may also be utilized if desired.

Figure 5:
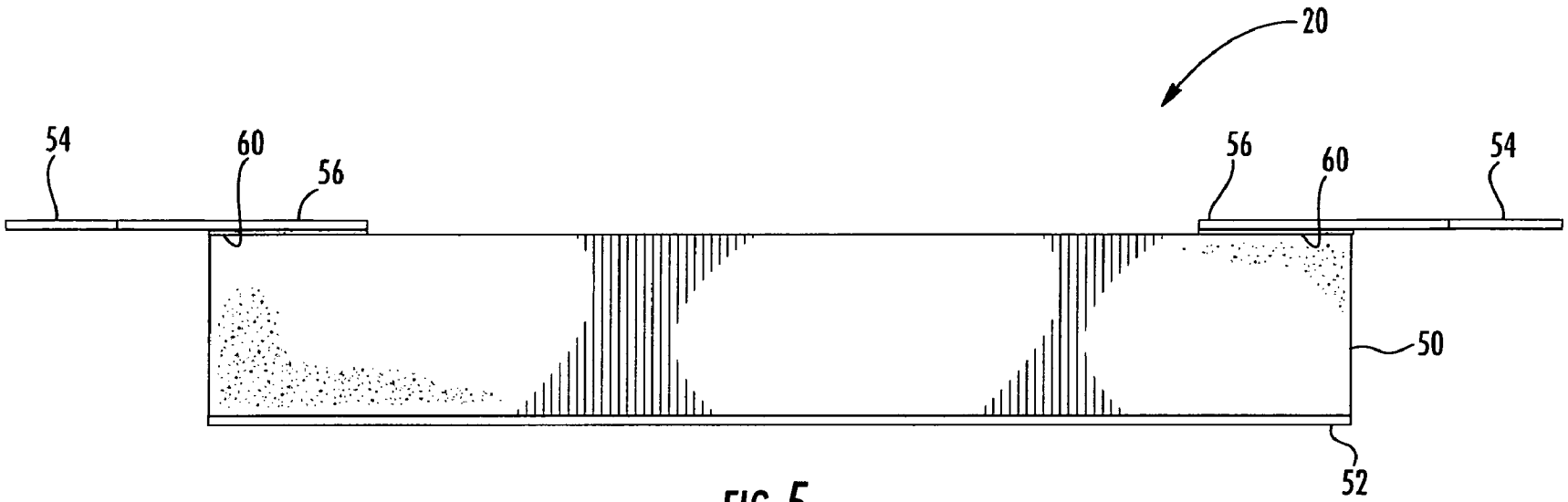
FIG. 5 is an end view of an exemplary replaceable mop head adapted for wrapped relation and connection to the mandrel.
Figure 6:
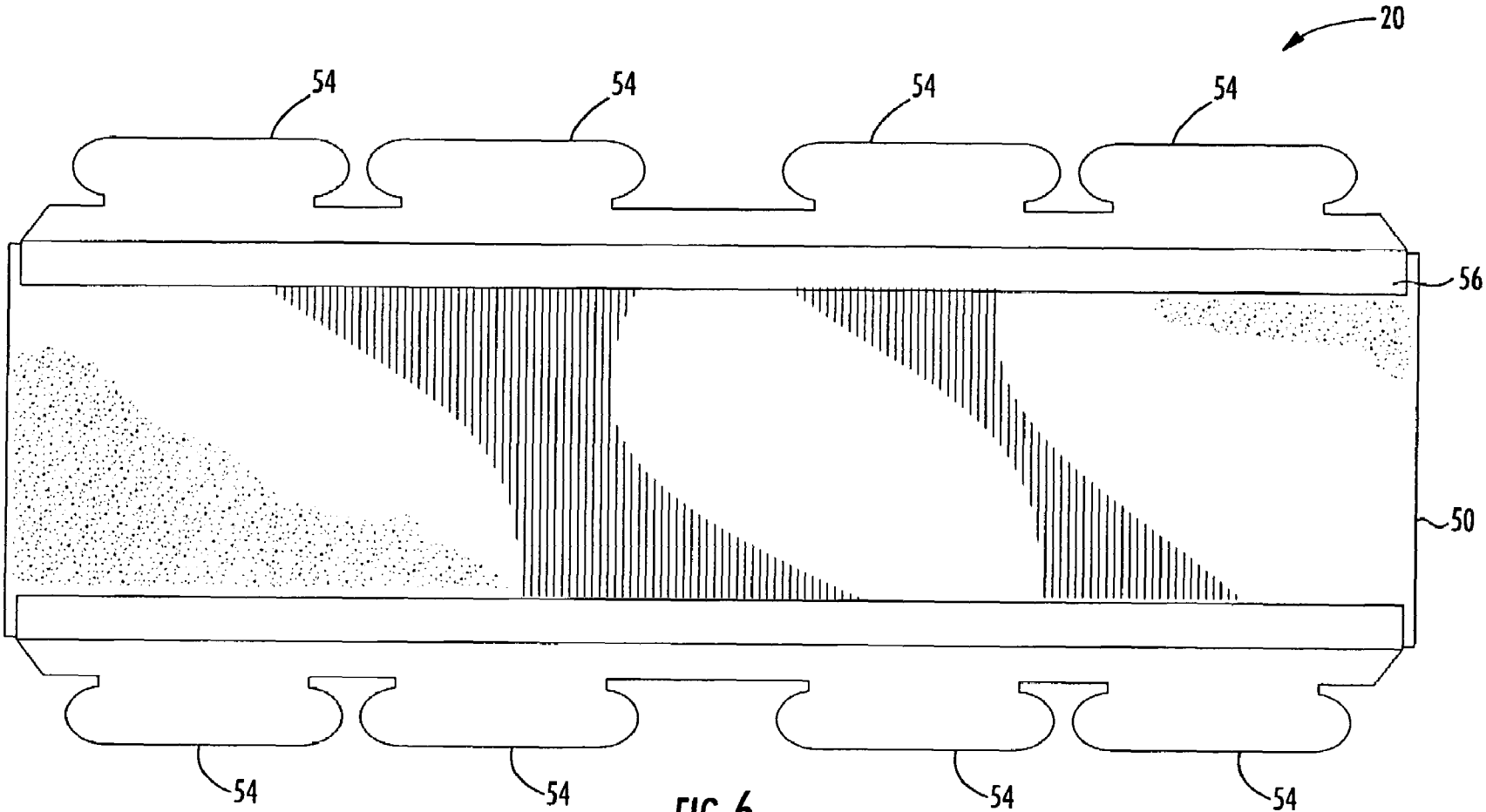
FIG. 6 is an elevation plan view of the replaceable mop head of FIG. 5.

FIGS. 5 and 6 illustrate an exemplary construction for a mop head 20 such as may be attached in wrapped relation to mandrel 22 as previously described. In this illustrated construction, the mop head 20 preferably includes a block of absorbent cellular foam 50 as will be well known to those of skill in the art with a layer of fabric 52 disposed in laminated relation across one side of the foam 50. The block of absorbent cellular foam 50 is normally substantially planar. By "normally substantially planar" it is meant that the block does not have substantial inherent edge to edge curvature.

The fabric 52 is preferably a non-snagging knit polyester fabric although other fabrics may likewise be utilized if desired. The fabric 52 is preferably secured to the foam 50 by flame lamination although adhesives or other attachment techniques may likewise be utilized if desired. While the fabric 52 is illustrated as covering only the lower face of the foam 50, it is likewise contemplated that the fabric 52 may also cover portions of any or all of the vertical surfaces of the mop head 20 if desired.

As shown, in the illustrated exemplary construction, the mop head 20 includes an arrangement of outwardly projecting mandrel engaging elements 54 projecting away from edges of the layer of foam 50 at the side of the foam facing away from the fabric 52. In the illustrated construction the mandrel engaging elements 54 are tabs incorporating enhanced diameter head portions mounted on reduced diameter neck portions which extend outwardly from a base portion 56. According to the illustrated arrangement the base portion 56 is secured to the foam layer 50 by a bead of adhesive along edge 60 although other connection mechanisms may likewise be utilized if desired.

According to the potentially preferred practice, the tab elements and base portion are preferably formed as a unitary structure from self supporting moderately flexible plastic material such as polypropylene or the like. As shown, in the attached state the base portion supporting the tab elements projects from the edge 60 inwardly toward the interior of the foam layer 50. The base portion preferably projects only a limited distance across the surface of the foam such that the mop head 20 remains substantially flexible at its interior to facilitate folding along its major axis.

Figure 7:
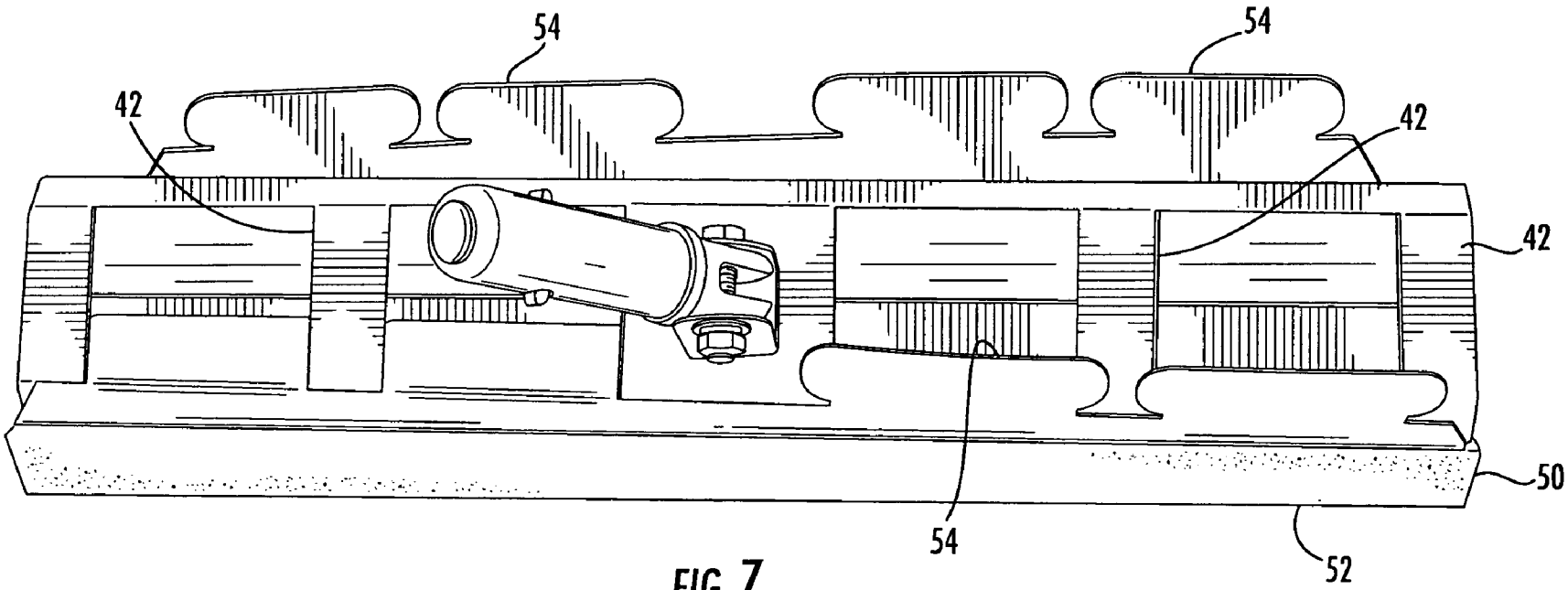
FIG. 7 is an elevation view illustrating an exemplary connective relation between the mandrel and the exemplary mop head of FIGS. 5 and 6.

Referring now the FIGS. 1 and 7, an exemplary attachment arrangement between the mop head 20 and mandrel 22 will now be described. As shown, due to the substantial retained flexibility of the mop head, it is possible to wrap the mop head 20 around the lower curved profile surface of the mandrel 22 such that the fabric 52 of the mop head projects outwardly. In this wrapped relation, the mandrel engagement elements 54 may be pressed into the openings between the spaced ribs 42 across the supper surface of the mandrel. Since the width of the head portions of the mandrel engaging elements 54 is greater than the distance between opposing edges of the ribs 42, the mandrel engaging elements are held in place beneath the ribs until they are displaced by manual manipulation. Thus, a secure yet easily reversible connection is established between the mandrel 22 and the mop head 20. Moreover, a substantially curved profile is established in the mop head 20 due to the mandrel geometry thereby providing a potentially desirable fabric covered curved cleaning surface.

Of course, it is also contemplated that any number of other attachment mechanisms may be used to connect the mop head to the mandrel. By way of example only, and not limitation, alternative attachment techniques may include complementary hook and loop fabric connections, snaps, tie elements and other attachments as may be known to those of skill in the art.

Figure 8:
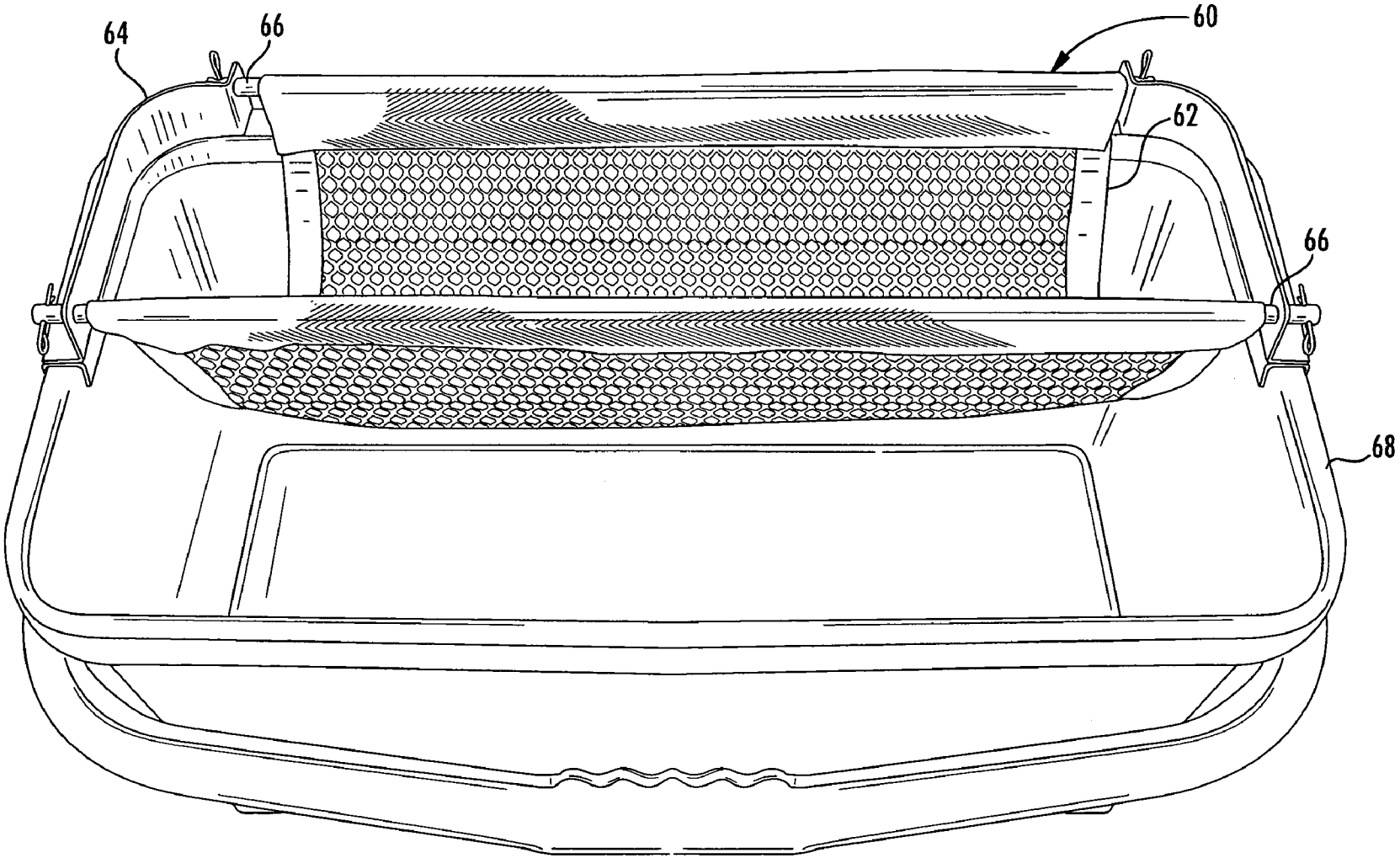
FIG. 8 illustrates a bucket supported shape-conforming wringer for use with the curve profile mop structure.

As noted previously, it is contemplated that the mop 10 may be used in conjunction with a shape conforming wringer to facilitate moisture removal during use. By way of example only, and not limitation, a contemplated shape conforming wringer system 60 suitable for use with the mop 10 is shown in FIG. 8. The contemplated wringer system 60 includes a sling 62 supported on a frame 64. As illustrated, the sling 62 preferably extends in hanging relation between rods 66 or other support members mounted on the frame 64 such that the sling 62 hangs downwardly into the interior of a bucket 68 such as may be used to contain a cleaning fluid. The sling 62 is preferably formed from a substantially open-mesh netting material which is highly permeable to fluid. The netting may be bordered by reinforcement fabric along its edges to promote strength.

As illustrated, the sling 62 is preferably arranged on the frame 64 so as to extend partially but not completely across the bucket 68. Thus, in operation, the mop 10 may be first immersed in a fluid contained within the bucket 68. Once the mop 10 is saturated, it may thereafter be pressed into the sling 62 between the rods 66 so as to place the sling in tension. As the mop 10 is pressed downwardly into the sling, the sling becomes tensioned and attempts to collapse onto itself thereby pressing into the mop and driving excess fluid out of the mop for drainage through the high permeability sling material. As will be appreciated, since the sling hangs substantially freely away from the rods 66, it is free to conform substantially around the curved profile of the mop with an efficient compressing force substantially around the entire mop head 20.

It is contemplated that elements of the wringing system including the frame 64 and rods 66 will each preferably be formed of a material which provides both structural integrity and substantial corrosion resistance. In this regard, metals such as aluminum, stainless steel, or the like may be particularly preferred. However, it is likewise contemplated that other structural materials including plastics and the like may also be utilized if desired.

As will be appreciated, the present invention provides a fully autoclaveable mop having a curved cleaning surface and which is highly adaptable to facilitate cleaning of floors, walls, ceilings or other surfaces as may be desired. Moreover, the mop utilizes a replaceable, autoclaveable mop head which may be adapted to assume a desired curved geometry and thereafter be held in place during use. In addition, a highly versatile and low maintenance wringer system which may be useful with this or other mops is also provided.

It is to be understood that while the present invention has been illustrated and described in relation to the potentially preferred embodiments, constructions and procedures, that such embodiments, constructions and procedures are illustrative only and that the invention is in no event to be limited thereto. Rather, it is contemplated that modifications and variations embodying the principles of the invention will no doubt occur to those with ordinary skill in the art. It is therefore contemplated and intended that the present invention shall extend to all such modifications and variations as may incorporate the broad principle of the invention within the true spirit and scope thereof.

The invention claimed is:

1. A mopping system comprising a user manipulated handle; a curved profile support mandrel operatively connected to the user manipulated handle, said support mandrel comprising a plurality of substantially coplanar spaced rib elements defining a substantially planar upper surface, the support mandrel further comprising a lower curved surface of convex profile projecting away from the upper surface; and a mop head comprising a normally substantially planar cellular foam body of predefined thickness, a fabric layer adhered in fixed relation at least partially across a lower face of the foam body; and a plurality of tab elements projecting outboard from opposing edges of an upper face of the foam body, wherein at least a portion of the tab elements include a base portion secured in affixed relation to the foam body, at least a portion of the tab elements comprising a neck portion operatively connected to a head portion, the head portion having a greater diameter than the neck portion, the mop head being bendable around an axis between said opposing edges such that the mop head may be wrapped at least partially around the support mandrel with the fabric layer facing outwardly away from the support mandrel and such that at least a portion of the tab elements may be inserted between the spaced rib elements, whereby the mop head defines a convex curved mopping surface.

2. The invention as recited in claim 1, wherein the foam body is substantially rectangular.

3. The invention as recited in claim 1, wherein the base portion comprises a strip of unitary construction with the tab elements.

4. The invention as recited in claim 3, wherein the base portion is adhesively secured to the upper face of the foam body adjacent said opposing edges.

5. The invention as recited in claim 1, wherein the support mandrel further comprises a support spine interconnecting the upper surface and the lower curved surface.

6. The invention as recited in claim 5, wherein the support spine includes an arrangement of apertures along its length.

7. The invention as recited in claim 5, wherein the support mandrel is formed substantially from stainless steel.

8. A mopping system comprising: a user manipulated handle; a curved profile support mandrel operatively connected to the user manipulated handle, said support mandrel comprising a plurality of substantially coplanar spaced rib elements defining a substantially planar upper surface, the support mandrel further comprising a lower curved surface of convex profile projecting away from the upper surface; a mop head comprising a normally substantially planar cellular foam body of predefined thickness, a fabric layer adhered in fixed relation at least partially across a lower face of the foam body; and a plurality of tab elements projecting outboard from opposing edges of an upper face of the foam body, wherein at least a portion of the tab elements include a base portion secured in affixed relation to the foam body, at least a portion of the tab elements comprising a neck portion operatively connected to a head portion, the head portion having a greater diameter than the neck portion, the mop head being bendable around an axis between said opposing edges such that the mop head may be wrapped at least partially around the support mandrel with the fabric layer facing outwardly away from the support mandrel and such that at least a portion of the tab elements may be inserted between the spaced rib elements, whereby the mop head defines a convex curved mopping surface; and a shape conforming wringer comprising a deformable sling of liquid permeable material disposed in hanging relation between a pair of support rods within a fluid holding container.

9. The invention as recited in claim 8, wherein the foam body is substantially rectangular.

10. The invention as recited in claim 8, wherein the base portion comprises a strip of unitary construction with the tab elements.

11. The invention as recited in claim 10, wherein the base portion is adhesively secured to the upper face of the foam body adjacent said opposing edges.

12. The invention as recited in claim 8, wherein the support mandrel further comprises a support spine interconnecting the upper surface and the lower curved surface.

13. The invention as recited in claim 12, wherein the support spine includes an arrangement of apertures along its length.

14. The invention as recited in claim 8, wherein the support rods are mounted within a frame adapted for mounting along an edge portion of the fluid holding container.

* * * * *